US005956672A

United States Patent [19]

Serizawa

[11] Patent Number: 5,956,672

[45] Date of Patent: Sep. 21, 1999

[54] WIDE-BAND SPEECH SPECTRAL QUANTIZER

[75] Inventor: Masahiro Serizawa, Tokyo, Japan

[73] Assignee: NEC Corporation, Japan

[21] Appl. No.: 08/911,234

[22] Filed: Aug. 15, 1997

[30] Foreign Application Priority Data

Aug. 16, 1996 [JP] Japan ..... 8-216459

[51] Int. Cl.[6] ..... G10L 5/00; G10L 7/02; G10L 7/04

[52] U.S. Cl. ..... 704/219; 704/220; 704/230

[58] Field of Search ..... 704/219, 220, 704/221, 222, 230

[56] References Cited

U.S. PATENT DOCUMENTS

| | | | |
|---|---|---|---|
| 5,581,652 | 12/1996 | Abe et al. | 704/222 |
| 5,668,925 | 9/1997 | Rothweiler et al. | 704/220 |
| 5,682,461 | 10/1997 | Silzle et al. | 704/230 |
| 5,699,382 | 12/1997 | Shoham et al. | 704/227 |
| 5,699,484 | 12/1997 | Davis | 704/230 |
| 5,778,335 | 7/1998 | Ubale et al. | 704/219 |
| 5,781,888 | 7/1998 | Herre | 704/219 |
| 5,812,971 | 9/1998 | Herre | 704/230 |

FOREIGN PATENT DOCUMENTS

| | | |
|---|---|---|
| 481374 | 4/1992 | European Pat. Off. . |
| 8-76799 | 3/1996 | Japan . |
| 91 06155 | 5/1991 | WIPO . |

OTHER PUBLICATIONS

R. Drogo de Jacovo, et al., "Some Experiments of 7 kHz Audio Coding at 16 kbit/s", IEEE Proceeding of ICASSP, 1989, pp. 192–195.

M. Yong, et al., "Subband Vector Excitation Coding With Adaptive Bit–Allocation", IEEE Proceeding of ICASSP, 1989, pp. 743–746.

V. Cuperman, et al., "Vector Predictive Coding of Speech at 16 kbits/s", IEEE Transactions on Communications, vol. COM–33, No. 7, Jul. 1985, pp. 685–696.

A. Gersho, et al., "Predictive Vector Quantization", Kluwer Academic Publishers, 1992, Chapter 13, pp. 487–517.

D. Esteban, et al., "Application of Quadrature Mirror Filters to Split Band Voice Coding Schemes", IEEE Proceeding of ICASSP, 1977, pp. 191–195.

K.K. Paliwal, et al., "Efficient Vector Quantization of LPC Parameters at 24 Bits/Frame", IEEE Transactions on Speech and Audio Processing, vol. 1, No. 1, Jan. 1993, pp. 3–14.

Rabiner, R., et al., *Digital Processing of Speech Signals*, "Linear Predictive Coding of Speech", pp. 396–405, Bell Laboratories, Inc. 1978.

*Primary Examiner*—David R. Hudspeth
*Assistant Examiner*—Martin Lerner
*Attorney, Agent, or Firm*—Ostrolenk, Faber, Gerb & Soffen, LLP

[57] ABSTRACT

A band splitter 3 makes predetermined frequency band splitting and computes each sub-band spectral coefficient for the cut out speech signal. Analyzers 5 and 7 each compute a spectral coefficient vector of each sub-band. Adders 15 and 17 each obtain a result e(i) of subtraction of each sub-band predicted spectral coefficient vector s_(i) computed in the band splitter 13 from a spectral coefficient vector s(i). A quantizer 19 quantizes the result e(i) of subtraction for the full band, thus outputting a quantized prediction error vector e_(i) from output terminals 21 and 22. A full-band quantized vector E_(i) is generated by combining the quantized prediction error vectors c_(i) of all the sub-bands. A synthesizer 9 outputs a full-band spectral coefficient vector S_(i) by combining the spectral coefficient vectors s(i) of all the sub-bands received from each of the analyzers 5 and 7. An optimum prediction circuit 11 computes a full-band predicted spectral coefficient vector Sˆ(i) from the full-band quantized vector E_(i) received from the quantizer 19 and the full-band predicted spectral coefficient vector S_(i). A band splitter 13 band splits the full-band predicted spectral coefficient vector Sˆ(i), and computes each sub-band predicted spectral coefficient vector s_(i).

9 Claims, 8 Drawing Sheets

WIDE-BAND SPEECH SPECTRAL QUANTIZER

BACKGROUND OF THE INVENTION

The present invention relates to a wide-band speech spectral quantizer and, more particularly, to improvements in spectral quantizers therein.

Prior art of such coders are disclosed in R. D. Jacovo et. al., "Some experiments of 7 kHz audio coding at 16 kbit/s", IEEE Proceeding of ICASSP, 1989, PP. 192–195 (Literature 1), M. Yong, "Subband vector excitation coding with adaptive bit-allocation", especially on pages 743–746 in S14.3, IEEE Proceeding of ICASSP, 1989 (Literature 2), V. Cuperman and A. Gersho, "Vector Predictive Coding of Speech at 16 kbit/s", July 1985, COM-33, No. 7, pp.685–696 (Literature 3), and A. Gersho and R. M. Gray, "Vector Quantization and Signal Compression", Kluwer Academic Publishers, 1992, pp. 487–517 (Literature 4).

In the prior art wide-band speech quantizers in wide-band speech coders described in Literatures 1 and 2, an input speech signal is divided or cut out into frames with a predetermined time interval, and each frame speech signal is frequency band split (or band split as hereinafter referred to). Then, spectral coefficients of each sub-band speech signal are obtained through analysis thereof and then quantized.

The spectral coefficient quantization performance is improved by methods described in Literatures 3 and 4. In these methods, spectral coefficients of the present frame are linearly predicted by using quantized spectral coefficients which were transmitted in past frames, and its prediction error is quantized.

The two methods noted above may be readily combined for use. A quantizer in which the two methods are combined, is referred to as a prior art wide-band speech spectral coefficient quantizer. In this prior art system, an input speech signal is first band-splitted, and spectral coefficients of each sub-band speech signal, which are obtained through analysis of the same sub-band speech signal, is used to linearly predict its error by inter-frame prediction, and the prediction error is quantized. Examples of this prior art system will now be described with reference to FIGS. 10 and 11.

FIG. 10 shows a first example of the prior art wide-band spectral coefficient quantizer. A frame circuit 2 cuts out frames with a predetermined window length (of 20 ms. for instance) from a speech signal inputted from an input terminal 1. A band splitter 3 band splits each frame (for instance into three sub-bands of 0 to 2, 2 to 4, and 4 to 8 kHz by sampling at 16 kH), and computes each sub-band speech signal. Analyzers 5 and 7 each computes spectral coefficients of each sub-band speech signal through analysis thereof. Each spectral coefficient usually consists of a plurality of different values. Thus, the spectral coefficients are hereinafter considered as a vector. Adders 15 and 17 each obtains a prediction error vector e(i) by subtracting a predicted spectral coefficient vector s_(i) computed in each of optimum prediction circuits 11 and 14 from a spectral coefficient vector s(i) outputted from each of the analyzers 5 and 7. Quantizers 20 and 24 obtain a quantized prediction error vector e_(i) by quantizing the prediction error vector e(i). Adders 8 and 18 each compute a quantized spectral coefficient vector s_(i) by adding the predicted coefficient vector s_(i), which is computed in each of the optimum prediction circuits 11 and 14, to the quantized prediction error vector e(i). The computed quantized spectral coefficient vector s^(i) is outputted from each of output terminals 21 and 22. The optimum prediction circuits 11 and 14 each compute the predicted coefficient vector s_(i) from the quantized error vector e_(i) received form each of the quantizers 11 and 14 and the spectral coefficient vector s(i) received from each of the analyzers 5 and 7. The prediction is executed for N past frames.

In the band splitter 3, the band division may be executed by a method using a Quadrature Mirror Filter (hereinafter referred to as QMF). The QMF is detailed in D. Estevan and C. Galand, "Application of Mirror Filters to Split Band Voice Coding Schemes", IEEE Proceeding of ICASSP, pp. 191–195, 1977 (Literature 5).

In the analyzers 5 and 7, the LPC analysis may be executed by means of autocorrelation analysis, covariance analysis, etc.

FIGS. 3 and 4 show examples of realizing the optimum prediction circuits 11 and 14. In the example shown in FIG. 3, Auto-Regressive (AR) prediction is executed. In the example shown in FIG. 4, Moving-Average (MA) prediction is executed.

Where the optimum prediction circuit shown in FIG. 3 is used, the adder 15 computes the quantized spectral coefficient vector s^(i) of the spectral coefficient from a past quantized prediction error vector e_(i) inputted from an input terminal 25 and the predicted spectral coefficient vector s_(i) by using an equation:

$$\hat{s}(i)=e_(i)+s_(i)$$

A buffer 14 stores quantized prediction error vectors for N past frames, N being referred to as inter-frame prediction order. A gain computer 33 receives the spectral coefficient vector s(i) from an input terminal 23 and the past spectral coefficient vectors s_(i−1), . . . , s_(1−N) from the buffer 1, and computes prediction errors α(1), . . . , α(N) by solving a matrix equation:

$$\begin{pmatrix} s_^T(i-1)s_(i-1) \ldots s_^T(i-1)s_(i-N) \\ \vdots \\ s_^T(i-1)s_(i-1) \ldots s_^T(i-1)s_(i-N) \end{pmatrix} \begin{pmatrix} \alpha(1) \\ \vdots \\ \alpha(1) \end{pmatrix} = \begin{pmatrix} s_^T(i-1)s(i) \\ \vdots \\ s_^T(i-1)s(i) \end{pmatrix}$$

where the vectors are all longitudinal vectors, and "T" in each vector term represents transposition of vector. A gain quantizer 35 quantizes the computed prediction errors α(1), . . . , a(N). In this case, it is efficient to vector-quantize each gain. A prediction circuit 37 receives the quantized prediction errors α^(1), . . . , α^(N) from the gain quantizer 35 and the predicted spectral coefficient vectors s_(i−1), . . . , s_(i−N) stored in the buffer 14, and computes the predicted spectral coefficient vector s_(i) by using the following equation, the computed predicted spectral coefficient vector s_(i) being outputted from an output terminal 21.

$$s_(i)=\alpha(1)s_(i-1)+\ldots+\alpha(N)s_(i-N)$$

The example shown in FIG. 4 is the same as the example shown in FIG. 3 except for that it does not use the adder 15. In this example, the buffer 14 thus receives the quantized prediction error vector e_(i) instead of the predicted spectral coefficient vector s_(i) given by equation (1). For the remainder, the processing in this example is the same as in the example shown in FIG. 3.

In the quantizers 20 and 24, the spectral coefficient quantization may be executed by using LPC coefficients as spectral coefficients. Specifically, in this method the LPC coefficient are converted into linear spectrum pair (LSP) coefficients, which are then vector quantized. Vector quantization of LSP coefficients are treated in, for instance, K. K. Paliwal and Bishnu and S. Atal, "Efficient Vector Quantization of LPC Coefficients at 24 Bits/Frame", IEEE Trans. on Speech and Audio Processing, Vol. 1, No. 1, pp. 3–14, January 1993 (Literature 7).

FIG. 11 shows a second example of the prior art wide-band speech quantizer. In the first example, the computations are executed for each frame, and the inter-frame prediction is executed by using the quantized prediction errors. In the second example, as shown in FIG. 11, fixed prediction circuits 12 and 16 each compute the predicted spectral coefficient vector s_(i) through inter-frame prediction by using the quantized prediction error vector e_(i) received from each of the quantizers 20 and 24 and a predetermined fixed prediction error. The first and second examples are different from each other only in the prediction circuit part, and the remainder of the construction is not described in detail. In the second example, deterioration of the prediction performance is anticipated, but on the merit side it is possible to reduce data to be transmitted for the prediction error quantization.

FIGS. 5 and 6 show examples of realizing the fixed prediction circuits 12 and 16 shown in FIG. 11. In the example shown in FIG. 6, MA prediction is executed.

The fixed prediction circuit shown in FIG. 6 and the optimum prediction circuit shown in FIG. 4 are different from each other in that the former circuit uses prediction errors stored in a gain table circuit 51, whereas the latter circuit uses prediction errors that are computed in a gain computer 33. The fixed prediction circuit shown in FIG. 5 and the optimum prediction circuit shown in FIG. 3 are different from each other likewise.

In the above prior art wide-band speech quantizers, however, the spectral coefficient quantization is executed without taking the correlationship among changes in sub-band spectral coefficients with time into considerations. This is so because the inter-frame prediction is executed independently in each sub-band.

SUMMARY OF THE INVENTION

An object of the present invention is therefore to solve the above problem by taking the correlationship among changes in sub-band spectral coefficients with time into consideration, specifically quantizing a prediction error obtained by full-band inter-frame prediction.

According to the present invention, there is provided a wide-band speech spectral quantizer comprising: a first means for splitting a frame speech signal into a plurality of split signals; a second means for developing coefficients representing a frequency characteristic of each split signal; a third means for obtaining subtraction results by subtracting predicted coefficients from the developed coefficients; a fourth means for quantizing the subtraction result concerning the plurality of split signals and developing quantization result of each split signal and a quantized synthesis result concerning the plurality of split signals; a fifth means for developing quantized coefficients concerning each split signal on the basis of the quantization result and the predicted coefficients; a sixth means for outputting the quantized coefficients; a seventh means for developing a synthesized coefficients concerning the plurality of split signals by synthesizing the coefficients; an eighth means for developing predicted synthesis coefficients concerning the synthesized coefficients on the basis of the quantized synthesis result and the synthesized coefficients; and a ninth means for developing the predicted coefficients concerning each split signal on the basis of the predicted synthesis coefficients.

According to another aspect of the present invention, there is provided a wide-band speech spectral quantizer comprising: a first means for splitting a frame speech signal into a plurality of split signals; a second means for developing coefficients representing a frequency characteristic of each split signal; a third means for obtaining subtraction results by subtracting predicted coefficients from the developed coefficients; a fourth means for quantizing the subtraction result concerning the plurality of split signals and developing quantization result of each split signal and a quantized synthesis result concerning the plurality of split signals; a fifth means for developing quantized coefficients concerning each split signal on the basis of the quantization result and the predicted coefficients; a sixth means for outputting the quantized coefficients; a seventh means for developing predicted synthesis coefficients concerning the synthesized coefficients on the basis of the quantized synthesis result; and an eighth means for developing the predicted coefficients concerning each split signal on the basis of the predicted synthesis coefficients.

The fourth means may comprise means for independently quantizing the subtraction results for each split signal, means for obtaining the quantized synthesis result by synthesizing the respective quantized results, and means for obtaining the quantization result concerning each split signal by splitting the quantized synthesis result.

Also, the fourth means may comprise means for obtaining a synthesized subtraction result by synthesizing the subtraction results, means for obtaining the quantized synthesis result by quantizing the synthesized subtraction result, and means for obtaining the quantization result concerning each split signal by splitting the quantized synthesis result.

Further, the fourth means may comprises means for obtaining a synthesized subtraction result by synthesizing the subtraction results, means for obtaining a split subtraction result by splitting the synthesized result, means for independently quantizing each split subtraction result, means for obtaining quantized synthesis result by synthesizing the respective quantization results; and means for obtaining the quantization result concerning each split signal by splitting the quantized synthesis result.

More specifically, according to other aspect of the present invention, there is provided a spectral quantizer for a wide-band speech coder comprising: a frame circuit for cutting out frames with a predetermined window length from a speech signal; a band splitter for making predetermined frequency band splitting and computing each sub-band spectral coefficient; analyzer for computing spectral coefficient vector of each sub-band; adder for obtaining a result of subtraction of each sub-band predicted spectral coefficient vector computed in the band splitter from the spectral coefficient vector; a quantizer for quantizing the result of subtraction for the full band, thus outputting a quantized prediction error vector; means for generating a full-band quantized vector by combining the quantized prediction error vectors of all the sub-bands; a synthesizer for outputting a full-band spectral coefficient vector by combining the spectral coefficient vectors of all the sub-bands received from the analyzer; an optimum prediction circuit for computing a full-band predicted spectral coefficient vector from the full-band quantized vector received from the quantizer and the full-band predicted spectral coefficient vector; and a band splitter for band splitting the full-band predicted spectral coefficient vector, and computing each sub-band predicted spectral coefficient vector.

As described before, in the present invention, spectral coefficient vectors obtained in respective sub-bands are combined into a single vector for full-band inter-frame prediction, and a resultant prediction error vector is quantized. It is thus possible to execute the spectral coefficient quantization by taking the correlationship among changes in sub-band spectral coefficients with time into consideration.

Other objects and features will be clarified from the following description with reference to attached drawings.

PREFERRED EMBODIMENTS OF THE INVENTION

Figure 1:
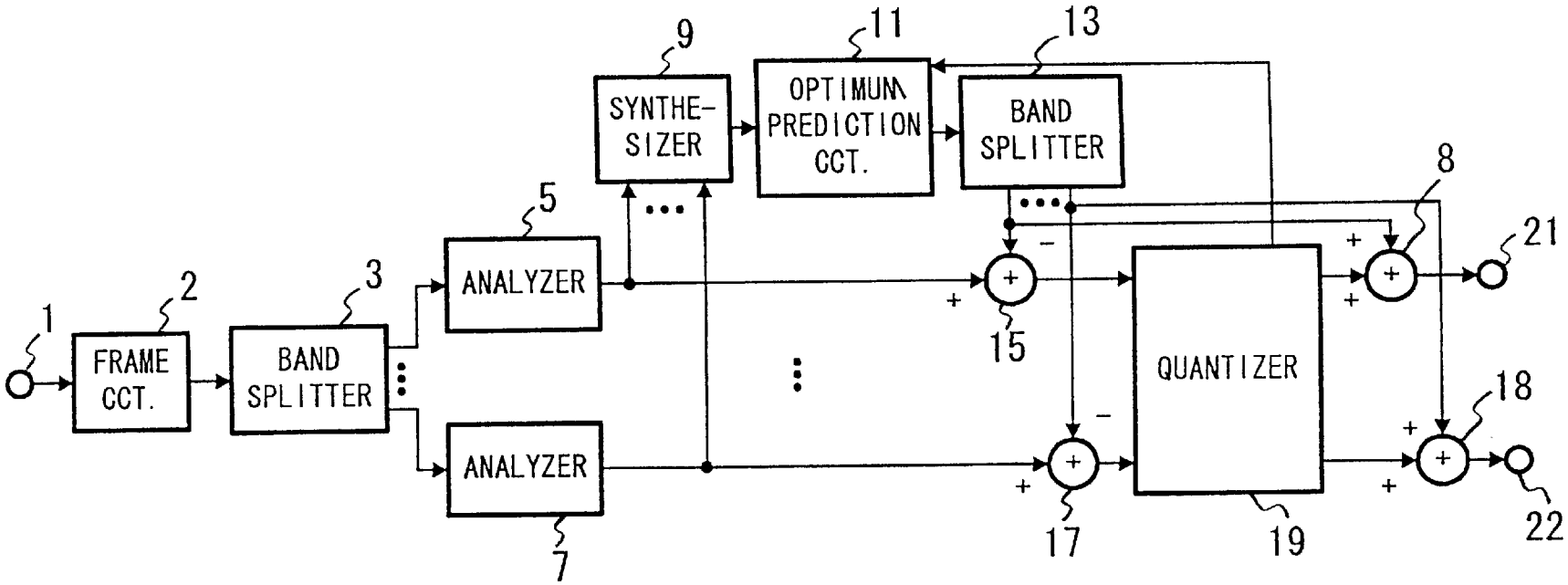
FIG. 1 shows a block diagram of a first embodiment of the quantizer according to the present invention.

Embodiments of the present invention will now be described with reference to the drawings.

A first embodiment of the quantizer will now be described with reference to FIG. 1. A frame circuit 2 cuts out frames with a predetermined window length (of approximately 20 ms for instance) from a speech signal inputted from an input terminal 1. A band splitter 3 band splits each frame speech signal (for instance into three sub-bands of 0 to 2, 2 to 4 and 4 to 8 kH by sampling at 16 kH), and computes a predicted spectral coefficient vector s_(i) of each sub-band. Analyzers 5 and 7 each computes a spectral coefficient vector for each sub-band. Adders 15 and 17 each obtain a prediction error vector e(i) by subtracting the predicted spectral coefficient vector s_(i) of each sub-band computed in the band splitter 3 from a spectral coefficient vector s(i). A quantizer 19 obtains a quantized prediction error vector e_(i) by quantizing the prediction error vector e(i). Adders 8 and 18 add a predicted spectral coefficient vector s_(i) computed in the optimum prediction circuit 11 to the quantized prediction error vector e_(i) and outputs a quantized spectral coefficient vector s^(i) from output terminals 21 and 22. The quantized prediction error vectors e_(i) of all the sub-bands are combined to obtain a full-band quantized vector $E_{13}$ (i). A synthesizer 9 outputs a full-band spectral coefficient vector S^(i) by combining the spectral coefficient vectors s(i) of all the sub-bands received from each of the analyzers 5 and 7. The optimum prediction circuit 11 computes a full-band predicted spectral coefficient vector S_(i) from the full-band quantized vector E_(i) which is received from the quantizer 19 and the full-band spectral coefficient vector S(i). A band splitter 13 computes the predicted spectral coefficient vector s_(i) through band splitting of a full-band predicted spectral coefficient vector S_(i).

A second embodiment of the present invention will now be described with reference to FIG. 2. This embodiment is different from the preceding first embodiment just like the second prior art example is different from the first prior art example. In the second embodiment, prediction errors stored in a predetermined fixed gain table are used for the inter-frame prediction.

Figure 7:
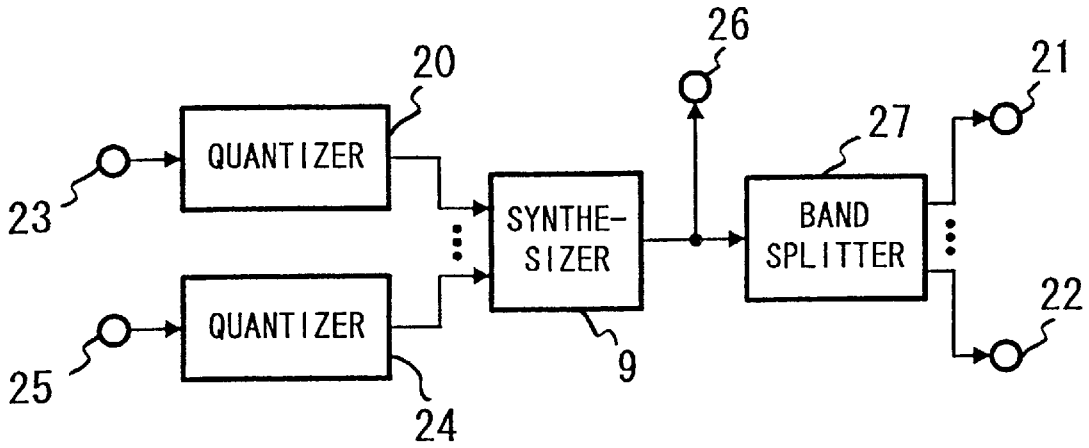
FIGS. 7 to 9 show block diagrams of the quantizer in the previous first and second embodiments of the present invention.
Figure 8:
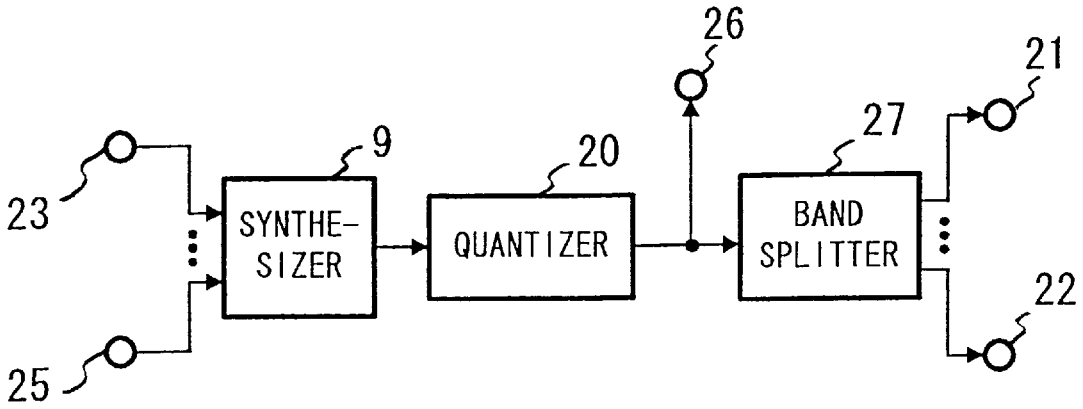
Figure 9:
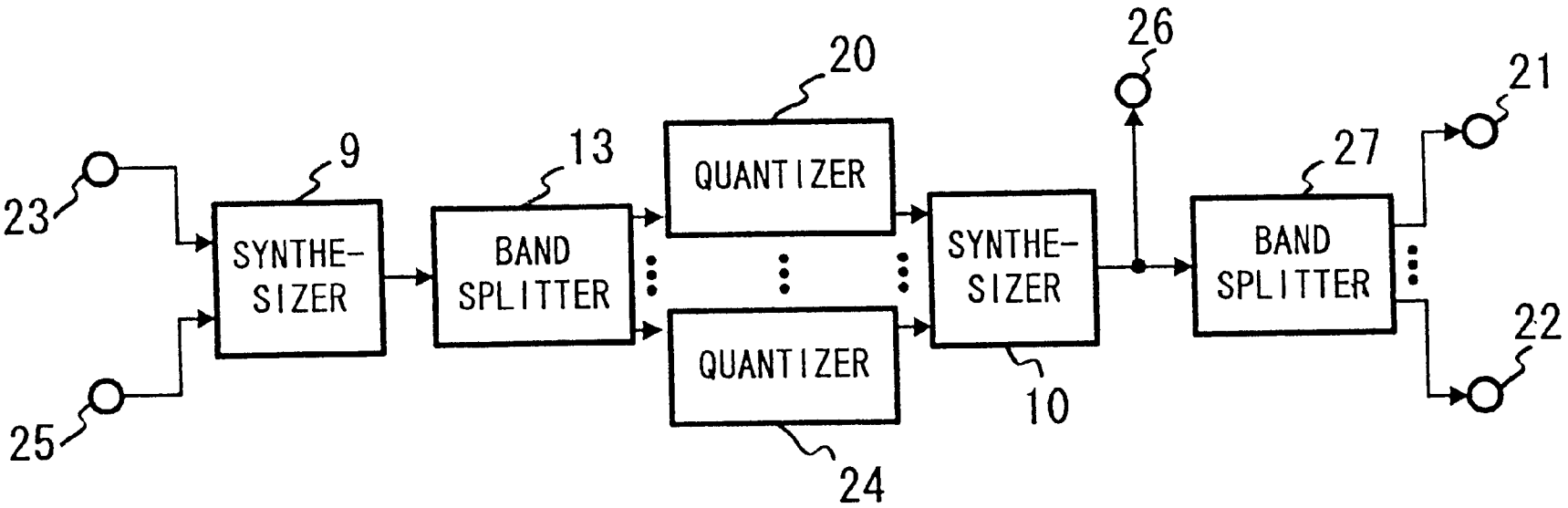
Figure 10:
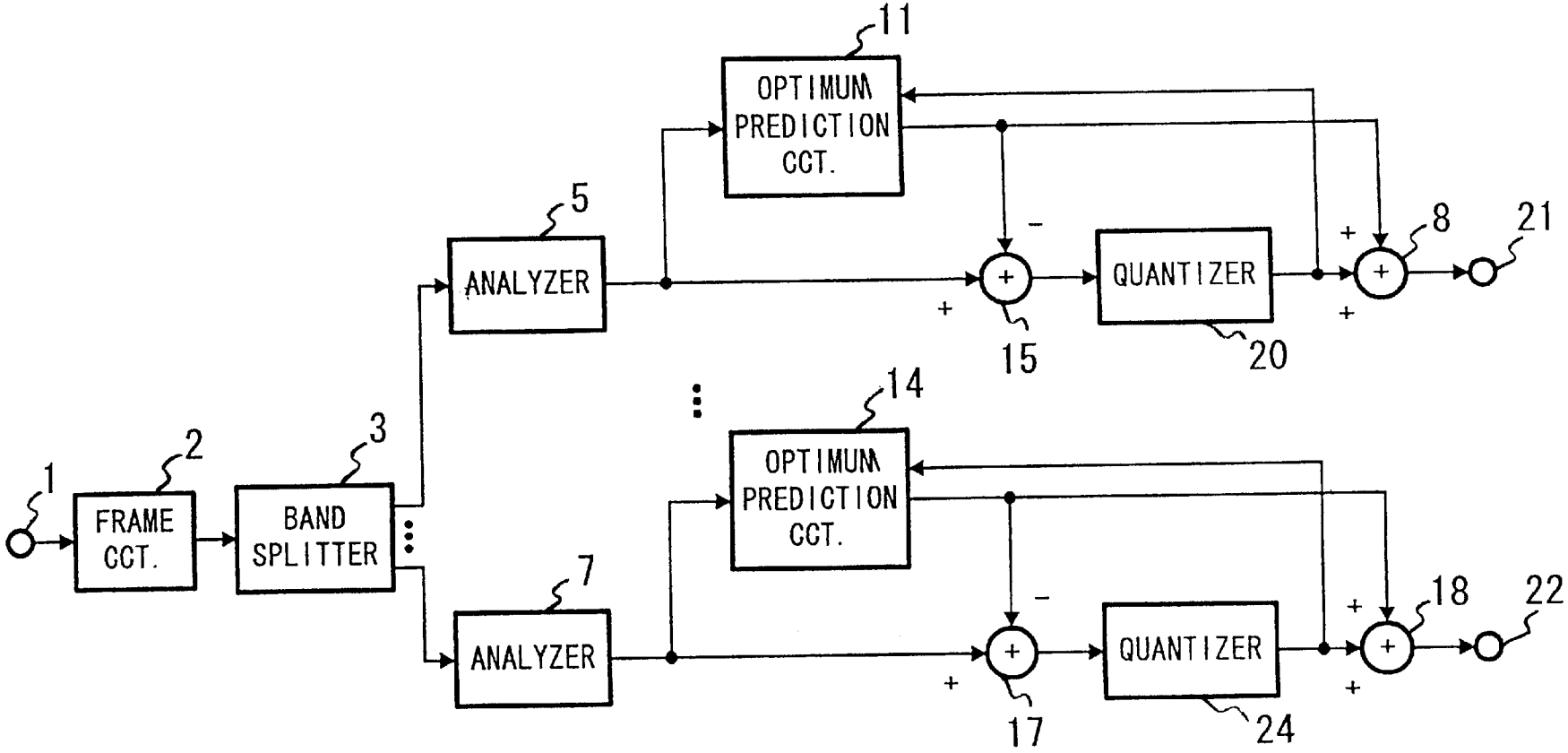
FIG. 10 PRIOR ART
FIG. 10 shows a first example of the prior art wide-band spectral coefficient quantizer.
Figure 11:
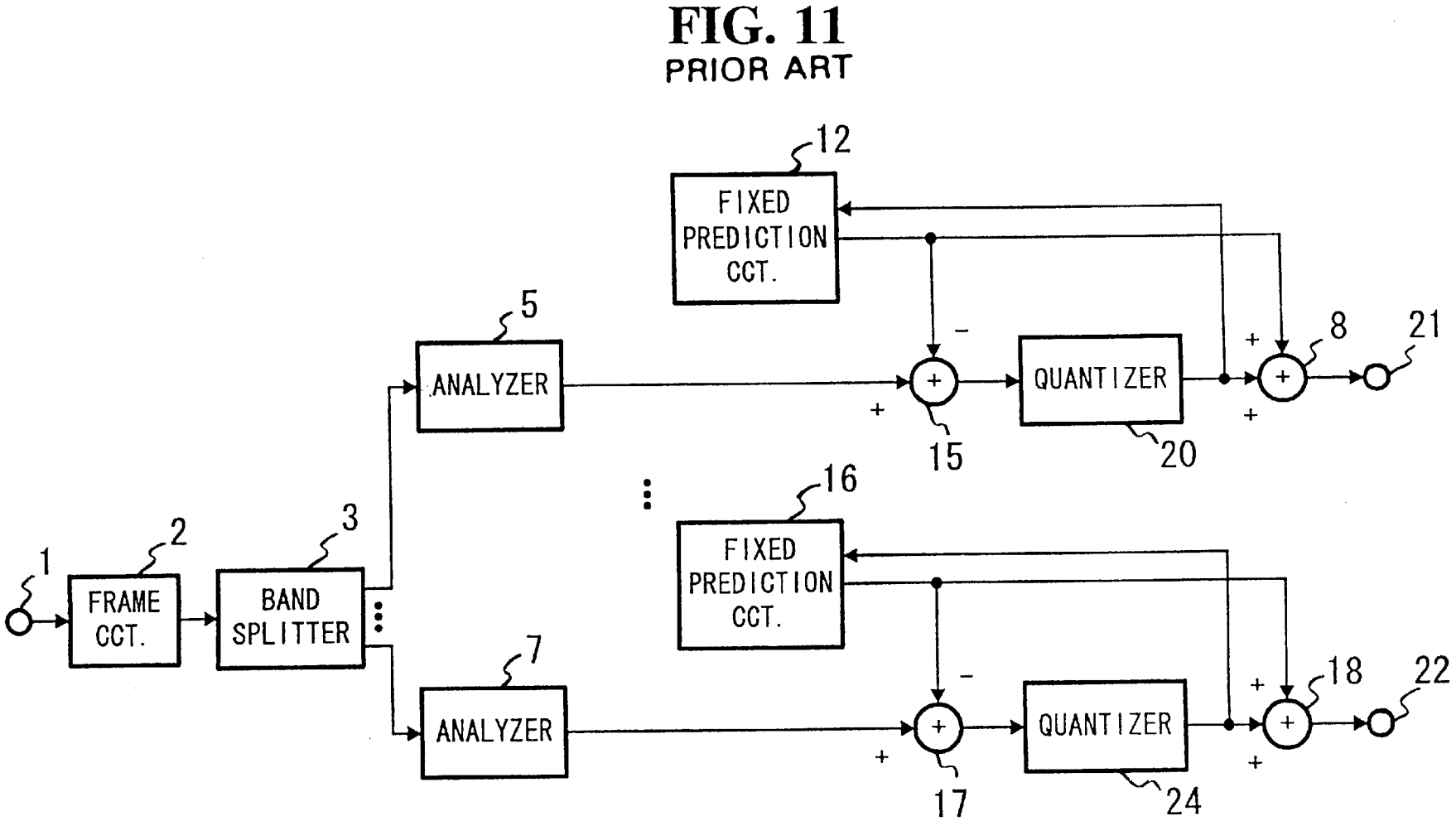
FIG. 11 PRIOR ART
FIG. 11 shows a second example of the prior art wide-band speech quantizer.

Third to a fifth embodiments of the present invention will now be described. These embodiments are modifications of the spectral coefficient quantizer in the previous first and second embodiments of the present invention. For this reason, they will be described only in connection with their portion where the quantizer 19 is realized. FIGS. 7 to 9 show such portions.

In the embodiment shown in FIG. 7, quantizers 20 and 24 each quantize the prediction error vector e(i) of each sub-band, which is inputted from each of input terminals 23 and 25. A synthesizer 9 outputs the full-band prediction error vector E_(i) from an output terminal 26 by combining the quantized prediction error vectors e_(i) of all the sub-bands. The quantized prediction error vector e_(i) of each sub-band is outputted from each of output terminals 21 and 22.

In the embodiment shown in FIG. 8, a synthesizer 9 outputs a full-band prediction error vector E(i) obtained by combining the prediction error vectors e(i) of all the sub-bands inputted from each of input terminals 23 and 25. A quantizer 20 outputs the full-band quantized vector E_(i) by quantizing the full-band prediction error vector E(i). This full-band quantized vector E_(i) is outputted from an output terminal 26. A band splitter 27 generates the quantized prediction error vector e_(i) of each sub-band by band-splitting the full-band quantized vector E_(i). The quantized prediction error vector e_(i) is outputted from each of output terminals 21 and 22.

In the embodiment shown in FIG. 9, a synthesizer 9 outputs a full-band prediction error vector E(i) obtained by combining the prediction error vectors e(i) of all the sub-bands inputted from each of input terminals 23 and 25. A band splitter 13 outputs a band-splitted prediction error vector e'_(i) of each sub-band by band-splitting again the full-band prediction error vector E(i). Quantizers 20 and 24 each quantizes the band-splitted prediction error vector e'_(i) of each sub-band. A synthesizer 10 outputs the full-band quantized vector E_(i) by combining the band-splitted quantized vectors e'_(i) of all the sub-bands. The full-band quantized vector E_(i) is outputted from an output terminal 26. A band splitter 27 generates the quantized prediction error vector e_(i) of each sub-band by band-splitting the full-band quantized vector E_(i). The quantized prediction error vector e_(i) of each sub-band is outputted from each of output terminals 21 and 22.

An example of the method of the spectral coefficient synthesis in the synthesizer 9 will now be described. Where the spectral coefficients are line spectral pairs (LSP) parameters, the LSP coefficient f(j, i) of each sub-band is obtained as follows, j representing the numbers of sub-bands in the order of lower frequencies. It is assumed that the band splitting is executed into (M+1) sub-bands.

It is also assumed that the order of the LSP coefficients is P in each sub-band.

$$f(0,1)=[a(0,1,i), \ldots, a(O,P,i)]$$

$$f(1,1)=[a(1,1,i), \ldots, a(1,P,i)]$$

$$f(M,1)=[a(M,1,i), \ldots, a(M,P,i)]$$

From the character of the LSP coefficients, we have $$0<a(j,1,i)<\ldots<a(j,P,i)<\pi$$

When combining these spectral coefficients, $\pi$ is added to the second sub-band coefficient, $2\pi$ is added to the third sub-band coefficient, and similar operations of addition are executed up to the last sub-band. After these additions, f(0,i), . . . ,f(M,i) are combined to obtain the full-band spectral coefficient F(i) as:

$$F(i)=[a(0,1,i),\ldots,a(0,P,i),$$
$$a(1,1,i)+\pi,\ldots,a(1,P,1)+\pi,$$
$$a(M,1,i)+M\pi,\ldots,a(M,P,1)+M\pi]$$

Where the QMF band-splitting filter noted above is used, sub-band inversion takes place. In the above cases, therefore, it is necessary to invert the order of the LSP coefficients in dependence on the sub-band.

It is possible to group the sub-bands into a plurality of groups of sub-bands and apply the embodiments of the quantizer according to the present invention, the prior art examples of the quantizer and quantization without inter-frame prediction in combination to the groups.

Figure 2:
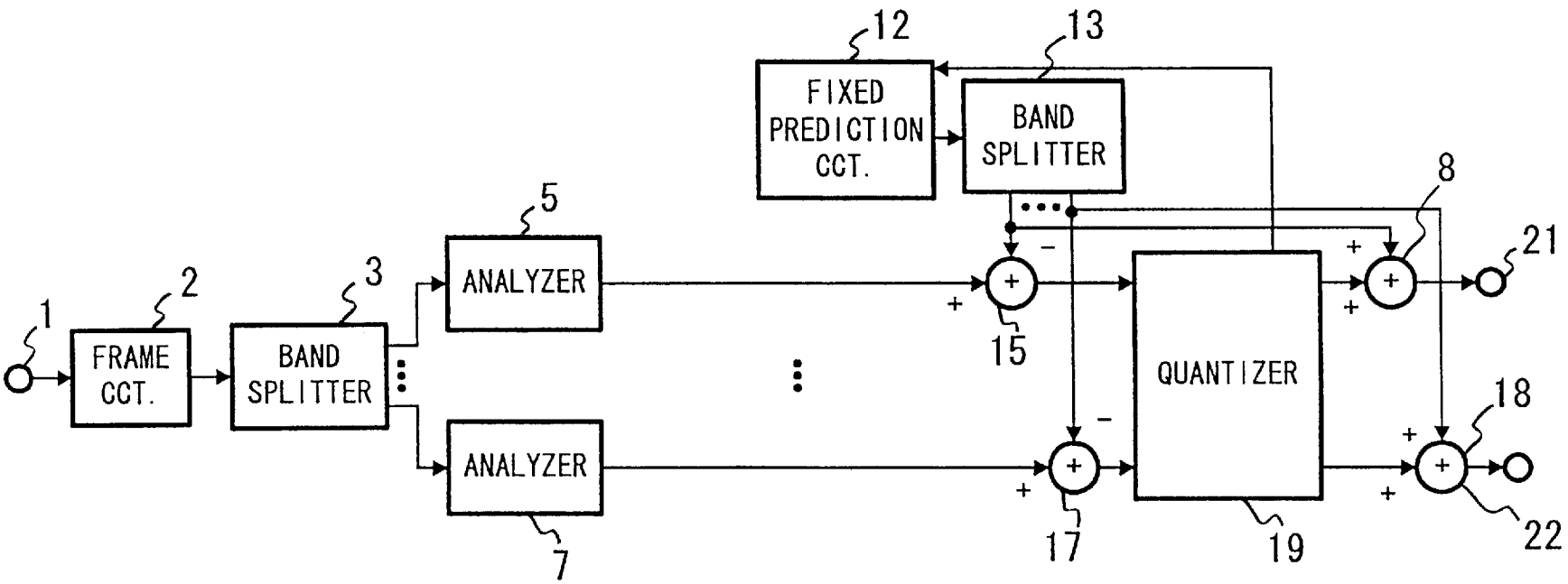
FIG. 2 shows a block diagram of a second embodiment of the quantizer according to the present invention.
Figure 3:
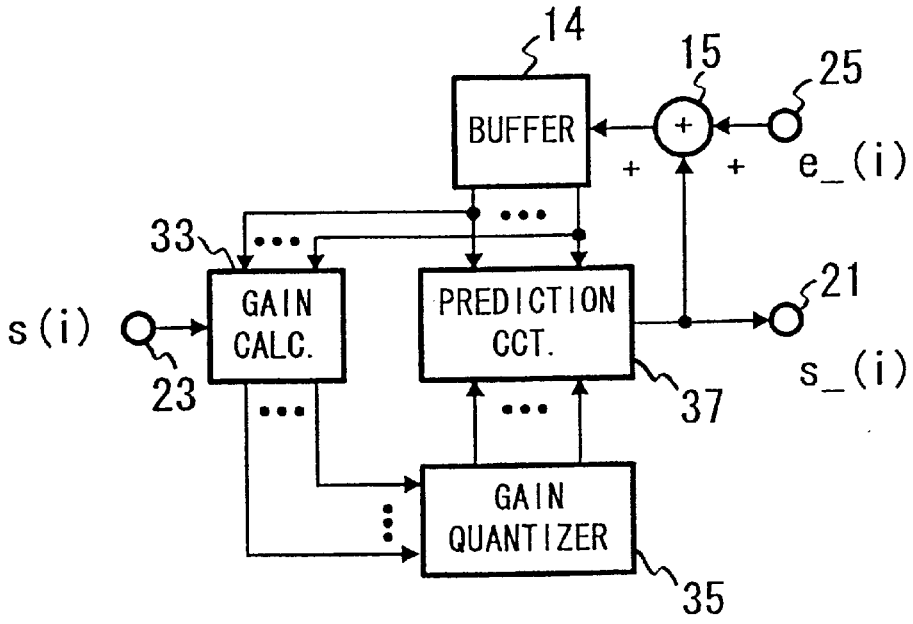
FIGS. 3 and 4 show examples of realizing the optimum prediction circuits 11 and 14 in the embodiment.
Figure 4:
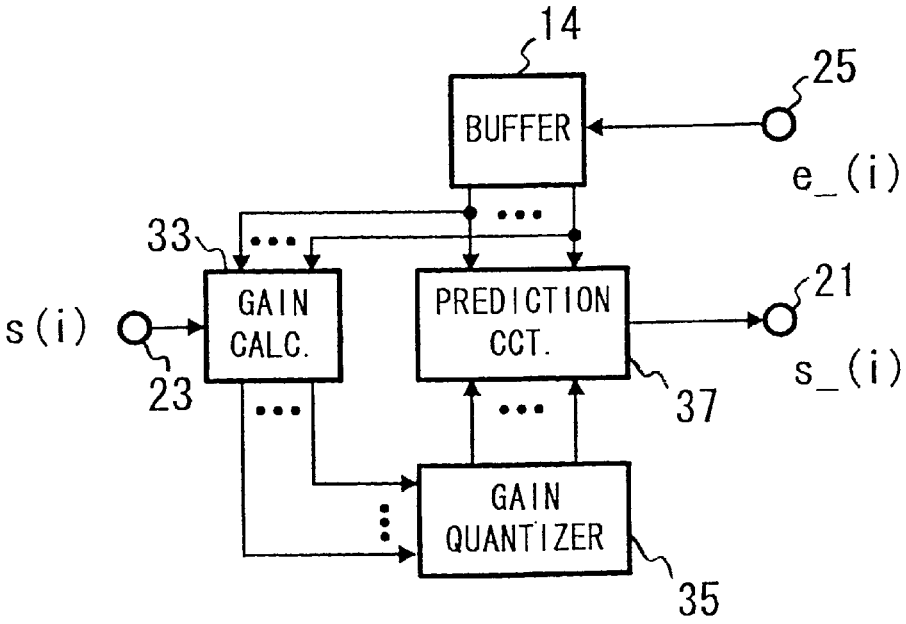
Figure 5:
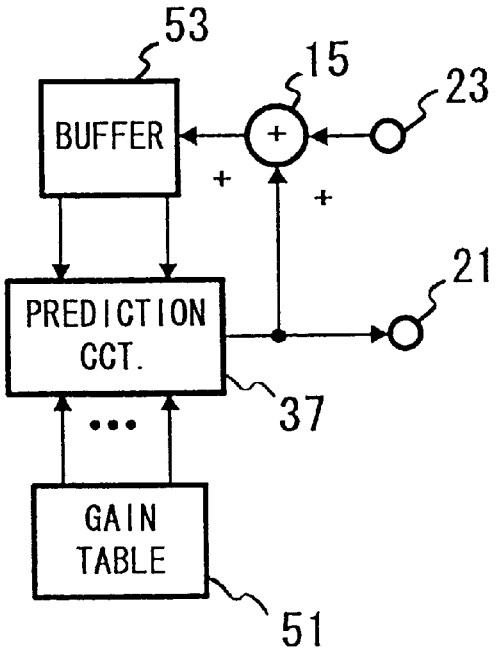
FIGS. 5 and 6 show examples of realizing the fixed prediction circuits 12 and 16 shown in FIG. 11.
Figure 6:
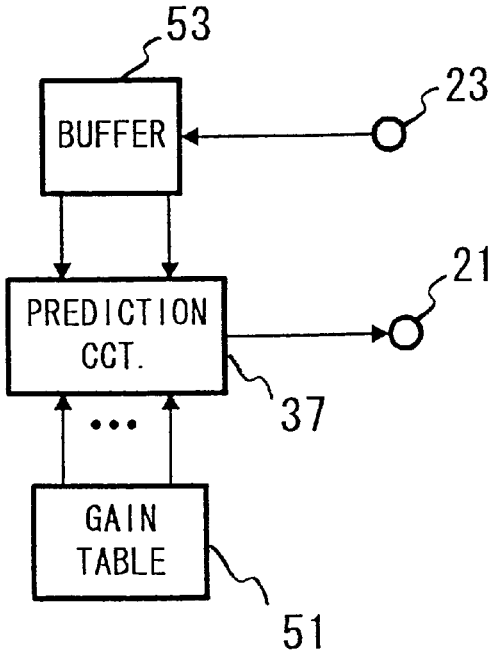

While the band splitter 3 in the above embodiments shown in FIGS. 1 and 2 split the input signal through the frequency band splitting, it is possible to further split the input signal through time division of each frame.

According to the foregoing present invention, it is possible to quantize spectral coefficients by taking the correlation of spectral coefficient changes among the sub-bands into considerations. This is so because it is not that the spectral coefficients obtained in the individual sub-frames are used for the inter-frame prediction independently for each sub-band, but an inter-frame prediction error of the full band is quantized.

Changes in construction will occur to those skilled in the art and various apparently different modifications and embodiments may be executed without departing from the scope of the present invention. The matter set forth in the foregoing description and accompanying drawings is offered by way of illustration only. It is therefore intended that the foregoing description be regarded as illustrative rather than limiting.

What is claimed is:

1. A wide-band speech spectral quantizer comprising:

a first means for splitting a frame speech signal into a plurality of split signals;

a second means for developing developed coefficients representing a frequency characteristic of each split signal;

a third means for obtaining subtraction results by subtracting predicted coefficients from the developed coefficients;

a fourth means for quantizing the subtraction results concerning the plurality of split signals and developing a quantization result of each split signal and a quantized synthesis resulting concerning the plurality of split signals;

a fifth means for developing quantized coefficients concerning each split signal on the basis of the quantization result and the predicted coefficients;

a sixth means for outputting the quantized coefficients;

a seventh means for developing synthesized coefficients concerning the plurality of split signals by synthesizing the developed coefficients;

an eights means for developing predicted synthesis coefficients concerning the synthesized coefficients on the basis of the quantized synthesis result and the synthesized coefficients; and a ninth means for developing the predicted coefficients concerning each split signal on the basis of the predicted synthesis coefficients.

2. The wide-band speech spectral quantizer according to claim 1, wherein the fourth means comprises means for independently quantizing the subtraction results for each split signal, means for obtaining the quantized synthesis result by synthesizing the respective quantized results, and means for obtaining the quantization result concerning each split signal by splitting the quantized synthesis result.

3. The wide-band speech spectral quantizer according to claim 1, wherein the fourth means comprises means for obtaining a synthesized subtraction result by synthesizing the subtraction results, means for obtaining the quantized synthesis result by quantizing the synthesized subtraction result, and means for obtaining the quantization result concerning each split signal by splitting the quantized synthesis result.

4. The wide-band speech spectral quantizer according to claim 1, wherein the fourth means comprises means for obtaining a synthesized subtraction result by synthesizing the subtraction results, means for obtaining a split subtraction result by splitting the synthesized result, means for independently quantizing each split subtraction result, means for obtaining quantized synthesis result by synthesizing the respective quantization results; and means for obtaining the quantization result concerning each split signal by splitting the quantized synthesis result.

5. A wide-band speech spectral quantizer comprising:

a first means for splitting a frame speech signal into a plurality of split signals;

a second means for developing developed coefficients representing a frequency characteristic of each split signal;

a third means for obtaining subtraction results by subtracting predicted coefficients from the developed coefficients;

a fourth means for quantizing the subtraction results concerning the plurality of split signals and developing a quantization result of each split signal and a quantized synthesis result concerning the plurality of split signals;

a fifth means for developing quantized coefficients concerning each split signal on the basis of the quantization result and the predicted coefficients;

a sixth means for outputting the quantized coefficients;

a seventh means for developing predicted synthesis coefficients concerning the synthesized coefficients on the basis of the quantized synthesis result; and an eighth means for developing the predicted coefficients concerning each split signal on the basis of the predicted synthesis coefficients.

6. The wide-band speech spectral quantizer according to claim 5, wherein the fourth means comprises means for independently quantizing the subtraction results for each split signal, means for obtaining the quantized synthesis result by synthesizing the respective quantized results, and means for obtaining the quantization result concerning each split signal by splitting the quantized synthesis result.

7. The wide-band speech spectral quantizer according to claim 5, wherein the fourth means comprises means for obtaining a synthesized subtraction result by synthesizing the subtraction results, means for obtaining the quantized synthesis result by quantizing the synthesized subtraction result, and means for obtaining the quantization result concerning each split signal by splitting the quantized synthesis result.

8. The wide-band speech spectral quantizer according to claim 5 wherein the fourth means comprises means for obtaining a synthesized subtraction result by synthesizing the subtraction results, means for obtaining a split subtraction result by splitting the synthesized result, means for independently quantizing each split subtraction result, means for obtaining quantized synthesis result by synthesizing the respective quantization results; and means for obtaining the quantization result concerning each split signal by splitting the quantized synthesis result.

9. A spectral quantizer for wide-band speech comprising:

a frame circuit for cutting out frames with a predetermined window length from a speech signal;

a band splitter for making predetermined frequency band splitting and computing each sub-band spectral coefficients;

an analyzer for computing a spectral coefficient vector of each sub-band;

an adder for obtaining a result of subtraction of each sub-band predicted spectral coefficient vector computed in the band splitter from the spectral coefficient vector;

a quantizer for quantizing a result of subtraction for the full band, thus outputting a quantized prediction error vector;

means for generating a full-band quantized vector by combining the quantized prediction error vectors of all the sub-bands;

a synthesizer for outputting a full-band spectral coefficient vector by combining the spectral coefficient vectors of all the sub-bands received from the analyzer;

an optimum prediction circuit for computing a full-band predicted spectral coefficient vector from the full-band quantized vector received from the quantizer and the full-band predicted spectral coefficient vector; and a band splitter for band splitting the full-band predicted spectral coefficient vector, and computing each sub-band predicted spectral coefficient vector.

* * * * *